US012421714B2

(12) United States Patent
Aronstein et al.

(10) Patent No.: US 12,421,714 B2
(45) Date of Patent: Sep. 23, 2025

(54) SYSTEM AND METHOD FOR SUPPORTING, RAISING AND LOWERING A MODULAR STRUCTURE

(71) Applicant: Levitation, LLC, Colorado Springs, CO (US)

(72) Inventors: William Aronstein, Denver, CO (US); James K. Aronstein, Denver, CO (US)

( * ) Notice: Subject to any disclaimer, the term of this patent is extended or adjusted under 35 U.S.C. 154(b) by 353 days.

(21) Appl. No.: 18/168,825

(22) Filed: Feb. 14, 2023

(65) Prior Publication Data

US 2023/0257989 A1 Aug. 17, 2023

Related U.S. Application Data

(60) Provisional application No. 63/267,952, filed on Feb. 14, 2022.

(51) Int. Cl.

| | |
|---|---|
| ***E04B 1/343*** | (2006.01) |
| ***E04G 23/06*** | (2006.01) |
| ***E04H 9/14*** | (2006.01) |

(52) U.S. Cl.

CPC ..... *E04B 1/34363* (2013.01); *E04G 23/065* (2013.01); *E04H 9/145* (2013.01)

(58) Field of Classification Search

CPC . E04B 1/3436; E04B 1/34352; E04G 23/065; E04G 21/163; E04H 9/145; E02D 35/005; E02D 27/32

See application file for complete search history.

(56) References Cited

U.S. PATENT DOCUMENTS

| | | | | |
|---|---|---|---|---|
| 3,632,088 | A | 1/1972 | Filipek et al. | |
| 3,796,055 | A * | 3/1974 | Mahony | E02D 35/00 405/230 |
| 3,852,970 | A | 12/1974 | Cassidy | |
| 5,083,404 | A | 1/1992 | Schulte | |
| 5,600,924 | A | 2/1997 | Forsberg | |
| 5,647,693 | A | 7/1997 | Carlinsky et al. | |
| 5,775,847 | A | 7/1998 | Carlinsky et al. | |
| 5,794,389 | A | 8/1998 | Vysma | |
| 5,904,446 | A | 5/1999 | Carlinsky et al. | |
| 5,970,665 | A | 10/1999 | Oudman | |
| 5,974,743 | A | 11/1999 | Vaia | |
| 6,030,149 | A | 2/2000 | Foo et al. | |
| 6,035,590 | A | 3/2000 | Lindsay | |

(Continued)

FOREIGN PATENT DOCUMENTS

| | | |
|---|---|---|
| AU | 1996047006 A1 | 7/1996 |
| AU | 697706 B | 8/1996 |

(Continued)

*Primary Examiner* — Gisele D Ford

(74) *Attorney, Agent, or Firm* — Martensen IP; Michael Martensen

(57) ABSTRACT

Embodiments disclosed herein include a building support system that includes a plurality of caissons that extend below building grade to one or more of an engineered depth and a competent subsurface. Each caisson is topped with a caisson cap that includes various elements and mechanisms for engaging with a structural steel member of a building module. A screw jack that operates within each caisson supports one or more building modules. Multiple screw jacks in multiple caissons raise and lower the entire building structure under electrical control, including remote control.

11 Claims, 19 Drawing Sheets

(56) References Cited

U.S. PATENT DOCUMENTS 6,079,905 A * 6/2000 Ruiz ..... E02D 27/48 405/230
6,142,710 A * 11/2000 Holland, Jr. ..... E04G 23/065 405/230
6,347,487 B1 2/2002 Davis
6,467,231 B1 10/2002 Carlinsky et al.
6,676,335 B1 * 1/2004 Hickman ..... E02D 27/48 405/230
6,684,577 B2 2/2004 Dimitrijevic
6,907,695 B2 6/2005 Pierce
7,267,345 B2 9/2007 Maggiori
7,918,314 B2 4/2011 Korchagin et al.
8,079,444 B1 12/2011 Rands et al.
8,177,193 B2 5/2012 Kooima et al.
8,425,155 B2 4/2013 Mikx
8,458,984 B2 6/2013 Marshall
8,516,680 B2 8/2013 Kooima et al.
8,700,191 B2 4/2014 Marsh et al.
8,813,432 B2 8/2014 Wurth
8,820,012 B2 9/2014 Hseih
8,850,764 B2 10/2014 Zimmerman et al.
8,926,223 B1 1/2015 Destefano et al.
8,966,855 B1 3/2015 Miller
8,991,105 B2 3/2015 Harvey
9,075,417 B2 7/2015 Marsh et al.
9,238,920 B1 1/2016 Carlinsky et al.
9,249,593 B2 2/2016 Perko et al.
9,249,594 B2 2/2016 Destefano et al.
9,353,537 B2 5/2016 Wensel
9,376,799 B2 6/2016 Ouellet
9,482,021 B2 11/2016 Smith et al.
9,580,912 B1 2/2017 Harkins
9,631,379 B2 4/2017 Koot
9,637,361 B2 5/2017 Long et al.
9,637,884 B1 5/2017 Destefano et al.
9,644,365 B1 5/2017 Destefano et al.
9,758,359 B2 9/2017 Kamphuis et al.
9,938,737 B1 4/2018 Garceau et al.
9,957,686 B2 5/2018 Zarraonandia
9,975,746 B2 5/2018 Buckingham et al.
10,081,962 B1 9/2018 Sluss
10,100,509 B2 10/2018 Smith et al.
10,145,134 B2 12/2018 Garceau et al.
10,208,474 B2 2/2019 Kelly et al.
10,214,927 B2 2/2019 Jenner
10,233,610 B1 3/2019 Nightingale
10,273,129 B2 4/2019 Long et al.
10,323,378 B2 6/2019 Piontkowski et al.
10,400,464 B2 9/2019 Garceau et al.
10,634,122 B1 4/2020 Clifton et al.
10,704,253 B1 7/2020 Houston et al.
10,711,428 B2 7/2020 Li et al.
10,745,906 B1 8/2020 Houston et al.
10,753,080 B1 8/2020 Houston et al.
10,794,062 B2 10/2020 Michels
10,829,928 B2 11/2020 Houston et al.
10,975,538 B2 4/2021 Adler et al.
10,988,922 B2 4/2021 Borden
11,242,680 B2 2/2022 Schambach et al.
11,274,432 B2 3/2022 Houston et al.
11,274,456 B2 3/2022 Forrest
11,279,602 B2 3/2022 Gilbert et al.
11,306,458 B1 * 4/2022 Wells ..... E02D 37/00
11,332,929 B2 5/2022 Zhou et al.
11,473,293 B2 10/2022 Mercolini
11,473,295 B2 10/2022 Houston et al.
2001/0046415 A1 * 11/2001 Rupiper ..... E02D 27/48 405/232
2002/0184834 A1 12/2002 Dimitrijevic
2002/0195593 A1 12/2002 Ardrey et al.
2003/0033760 A1 * 2/2003 Rogers ..... E04B 1/34352 52/126.6
2003/0033772 A1 2/2003 Russell
2004/0211945 A1 10/2004 Maggiori
2004/0261338 A1 * 12/2004 De Cherance ..... E02D 27/06 52/292
2005/0005562 A1 1/2005 Henderson et al.
2005/0262776 A1 12/2005 Smushkovich
2006/0117678 A1 6/2006 Neighbours
2009/0138126 A1 5/2009 Marsh et al.
2009/0142140 A1 * 6/2009 Collina ..... E04G 23/06 405/230
2009/0188177 A1 7/2009 Wensel et al.
2009/0211174 A1 8/2009 Henderson et al.
2010/0207079 A1 8/2010 Kooima et al.
2011/0023384 A1 2/2011 Marshall
2011/0062399 A1 3/2011 Kooima et al.
2011/0088336 A1 4/2011 Larsen, Jr.
2012/0204512 A1 8/2012 Trinko et al.
2012/0255242 A1 * 10/2012 Patton ..... E01D 15/14 52/741.15
2013/0233646 A1 9/2013 Boysaw
2014/0069740 A1 3/2014 Wurth
2014/0096458 A1 4/2014 Benet
2014/0222171 A1 8/2014 Marsh et al.
2014/0259989 A1 9/2014 Gregory et al.
2014/0290154 A1 10/2014 Perko et al.
2014/0346421 A1 11/2014 Wensel
2015/0101279 A1 4/2015 Koot
2015/0102275 A1 4/2015 Destefano et al.
2015/0121778 A1 5/2015 Rawding
2015/0167331 A1 6/2015 Smith et al.
2015/0204091 A1 7/2015 Long et al.
2015/0354198 A1 12/2015 Ouellet
2016/0010349 A1 1/2016 Jenner
2016/0016767 A1 1/2016 Jones
2016/0108636 A1 4/2016 Carlinsky et al.
2016/0237676 A1 8/2016 Devlin et al.
2016/0280518 A1 9/2016 Kamphuis et al.
2016/0281382 A1 9/2016 Groves
2017/0022698 A1 1/2017 Zacarias
2017/0167129 A1 6/2017 Long et al.
2017/0254066 A1 9/2017 Smith et al.
2017/0342728 A1 11/2017 Wensel
2018/0135269 A1 * 5/2018 Reusing ..... E02D 5/223
2018/0142461 A1 5/2018 Kelly et al.
2018/0223550 A1 8/2018 Garceau et al.
2018/0230707 A1 8/2018 Parker
2019/0048603 A1 2/2019 Garceau et al.
2019/0119876 A1 * 4/2019 Grussenmeyer .... E04G 23/0229
2019/0338529 A1 11/2019 Michels
2020/0190790 A1 6/2020 Schambach et al.
2020/0232204 A1 7/2020 Borden
2020/0308822 A1 10/2020 Houston et al.
2020/0385981 A1 12/2020 Houston et al.
2021/0179402 A1 6/2021 Gilbert et al.
2021/0310265 A1 10/2021 Chu et al.
2021/0372074 A1 12/2021 Hodge
2022/0018083 A1 * 1/2022 Ledwith ..... E02D 35/005
2022/0120108 A1 4/2022 Harris
2022/0145614 A1 5/2022 Schambach et al.
2022/0170224 A1 6/2022 Trebil
2022/0227609 A1 7/2022 Jin et al.
2024/0301710 A1 * 9/2024 Wensel ..... B66F 3/46

FOREIGN PATENT DOCUMENTS

AU 1997028285 A1 9/1998
AU 2016235073 B2 2/2019
CA 2210789 A1 7/1996
CA 2272472 A1 5/1998
CA 2282652 A1 9/1998
CA 2893271 A1 6/2014
CA 2904191 A1 9/2014
CA 2934319 A1 7/2015
CH 715935 A1 9/2020
EP 3334875 A1 6/2018
EP 3461970 B1 7/2020
EP 3851618 A1 7/2021
GB 2534044 A 7/2016
GB 2537364 A 10/2016
GB 2574153 A 11/2019
GB 2589258 A 5/2021

(56) References Cited

FOREIGN PATENT DOCUMENTS

| | | | |
|---|---|---|---|
| WO | 1996022426 | A1 | 7/1996 |
| WO | 1998022663 | A1 | 5/1998 |
| WO | 1998038390 | A1 | 9/1998 |
| WO | 2002100758 | A1 | 12/2002 |
| WO | 2004057122 | A1 | 7/2004 |
| WO | 2016110819 | A1 | 7/2016 |
| WO | 2016166519 | A1 | 10/2016 |
| WO | 2017025737 | A1 | 2/2017 |
| WO | 2019236721 | A1 | 12/2019 |
| WO | 2020188394 | A1 | 9/2020 |

* cited by examiner

SYSTEM AND METHOD FOR SUPPORTING, RAISING AND LOWERING A MODULAR STRUCTURE

RELATED APPLICATIONS

The present application relates to and claims the benefit of priority to U.S. Provisional Patent Application Ser. No. 63/267,952 filed 14 Feb. 2022, which is incorporated herein by reference in its entirety for all purposes as if fully set forth herein.

FIELD OF THE INVENTION

Embodiments of the present invention relate, in general, to building structural elements and more particularly to systems and methods for raising and lowering a structure.

BACKGROUND

For centuries homes have been built and people have formed townships near bodies of water. Bodies of water (rivers, oceans, seas, etc.) provide a means for food, transportation and recreation. Yet, these same areas are rife with risk. Chief among these risk is flooding. Areas in the United States prone to flooding include intercoastal Florida, flood zones in Texas, coastal areas, riparian areas and the like. As global warming increases, sea level rise continues and floods become more common and extreme, risk of catastrophic water and flood damage to dwellings increases.

In some cases certain areas otherwise desirable in which to build are becoming too expensive to insure from flood risk leaving owners to alone bear the risk of changing and unpredictable weather. The alternative is build homes and similar structures on stilts. Stilted construction is expensive and not very appealing from an aesthetic and livability standpoint. And homes that have a static foundation system that cannot adapt to changing environmental conditions.

Other solutions to this rising risk have been conceived but each lack practicality. These include an Antarctic research facility in which employees use hydraulic jacks to adjust the buildings position above the ground for snow height. it also allows the building to be relocated to other ground that may have different pitch, thereby allowing the unit to self-level when the ice shifts. While perhaps useful in Antarctica for elite research institutions, hydraulic systems to raise a residence is cost prohibitive.

Another is the Arkup "livable" vessel. Effectively this concept includes a barge or spud barge with a home built on top. This home uses a jacking system that runs through the house to lift the frame of the house above the water but operates more as a boat a foundation system. it is not permanent system and cannot withstand larger weather events.

Thailand is known for its Floating House Project. This approach uses a buoyant foundation system, whether this is a bubble slab, concrete hull, or some type of pier and track system that allows the building to raise up as flood waters push up the buoyant foundation. This system is passive and the building is sitting in the water, which, when the water is turbulent or carrying debris is problematic.

Building screw jacks have also been considered and are very common. These are typically used for temporary home repair, construction or even to raise a house to change foundation from flood risk. These jacks are typically used as a construction tool are then removed from the house once a new foundation is built. These are typically small jacks used on small spreads to lift houses. They too are not a permanent solution.

What is needed is a system for raising a residence in response to and in accordance with a rising flood level. These and other deficiencies of the prior art are addressed by one or more embodiments of the present invention. Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out in the attached description.

BRIEF DESCRIPTION OF THE DRAWINGS

The Figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 1:
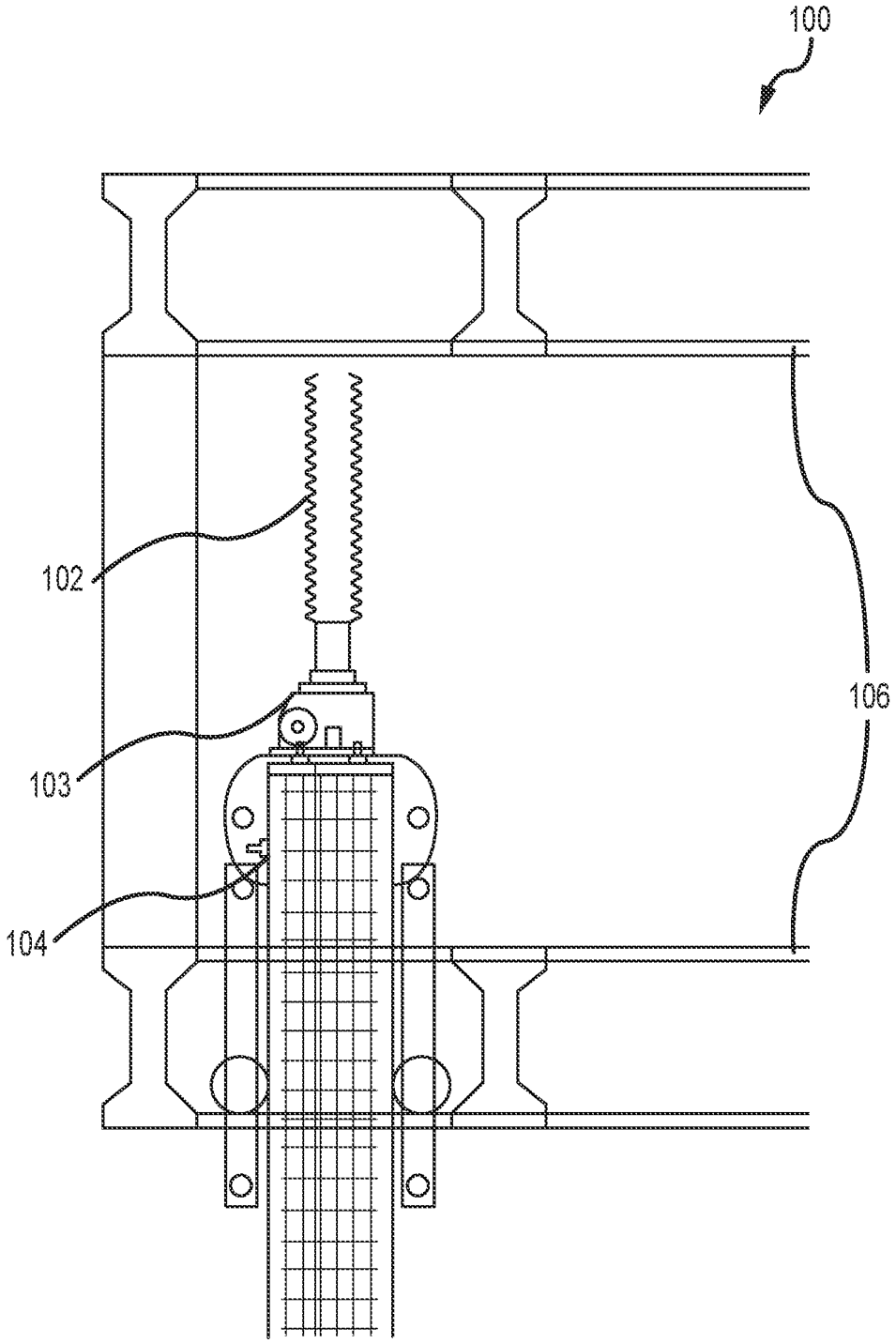
FIG. 1 is a diagram of an embodiment of a screw jack assembly.

A dynamic foundation system for homes and other buildings is hereafter described by way of example. The dynamic foundation system of the present invention allows the building to adjust its height rapidly and regularly without further construction or modification. The system is comprised of three general elements. One element is a modular building that is constructed with a structural exoskeleton. Another element is a drilled concrete caisson that extends with casing above the ground. A third element is a translating screw jack that connects the modular building exoskeleton to the caisson via a caisson cap.

The structural exoskeleton allows the structure form a rigid span between the caisson and to be supported (or hung) from the second (or other) level rather than being supported from the bottom level like a traditional building. The caissons provide grounding to the soil in a predictable manner with the depth of the caisson being adjusted to accommodate any soil type. The caissons also provide all of the vertical support for the building via the attachment to the jacking system. Significantly, the caissons extend up through the building and remain in contact with the exoskeleton, regardless of its vertical position, thereby providing lateral resistance eliminating lateral forces from the jacking system. The combination of these three elements as well as some other features described below allow this foundation system to be reactive to a changing environment while providing the security and durability of a traditional foundation system.

Embodiments of the present invention are hereafter described in detail with reference to the accompanying Figures. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

The following description with reference to the accompanying drawings is provided to assist in a comprehensive understanding of exemplary embodiments of the present invention as defined by the claims and their equivalents. it includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

The terminology used herein is for the purpose of describing particular embodiments only and is not intended to be limiting of the invention. As used herein, the singular forms "a," "an" and "the" are intended to include the plural forms as well, unless the context clearly indicates otherwise. Thus, for example, reference to "a component surface" includes reference to one or more of such surfaces.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined, all terms (including technical and scientific terms) used herein have the same meaning as commonly understood by one of ordinary skill in the art to which this invention belongs. it will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

it will be also understood that when an element is referred to as being "on," "attached" to, "connected" to, "coupled" with, "contacting", "mounted" etc., another element, it can be directly on, attached to, connected to, coupled with or contacting the other element or intervening elements may also be present. in contrast, when an element is referred to as being, for example, "directly on," "directly attached" to, "directly connected" to, "directly coupled" with or "directly contacting" another element, there are no intervening elements present. it will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. it will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

In one embodiment of the present invention a foundation system allows the building to be raised in flood events and lowered back to grade after floods subside. This system would facilitate overwater construction where a home could follow the elevations of tides and not need to be stilted excessively above the water. Accordingly, the present invention enables growth of usable overwater homes and building in areas with tidal flows, hurricanes and storm surges that would be otherwise unusable.

One aspect of the present invention is the ability to self-level a home and/or building that may be subjected to differential settlement or soil expansion, making the consequences of building on variable or undesirable soils less severe. As one of reasonable skill in the relevant art can appreciate, the present invention can also prevent long term costs and damage to buildings in difficult building geologies (e.g. earthquake liquefaction settlement in California, expansive clays in Colorado, Karst geology in Pennsylvania, melting tundra in Alaska, soil erosion in coastal Carolina, and the like)

And while primarily contemplated for an aquatic risk-based environment, the present invention could be used in high alpine environment where home could be raised to meet snow levels as they accumulate through the year and then could be lowered as snow melts.

The present invention is comprised of several components. They include

Caisson

The Caisson, in one embodiment, provides the interface with the geotechnical substate for the building. It also provides the vertical and lateral structural integrity one which the system rests.

Below Ground Caisson

The caisson includes a below ground section and an above ground section. The below ground portion relies on both skin friction and end bearing to support and anchor the building in place and prevent settlement or displacement due to other forces. The underground caisson is modifiable depending on conditions and design of building. it can have its width, depth, reinforcement and concrete specification changed as needed and can be belled at the bottom and/or incorporate shear rings.

Above Ground Caisson

The above ground portion is similar to the below ground portion and can be configured based on the building design. Because there is no soil to contain the concrete when it is poured, the above ground caisson requires an integral and permanent casing. This casing serves as both formwork for the caisson, but also serves as a long term protective barrier from the elements.

The casing for the above ground caisson can be adjusted in any direction to make up for any construction tolerance issues caused during the below ground drilling.

Caisson Top Cap

At the top of the caisson there is a top cap. This top cap is critical as it can be adjusted to account for the construction imperfections of pouring caissons. The cap can be adjusted to create the form an surface for mounting the jacking system. The cap also contains leaves or knife plates that project out. These leaves serves as the interface surface between the building exoskeleton and caisson. By doing so the caisson provides lateral support to the modular frame. A mechanical connection is created/engaged between the leaves and the exoskeleton. When this connection is engaged all vertical and lateral forces are directly transferred from the exoskeleton to the caisson. This effectively bypasses the jacking assembly. This connection should be engaged except when the building is actively or about to actively be adjusted. This maintains the integrity of jacking system even during high load events like hurricanes.

In another version, the top cap contains a sleeve that creates a cavity in the middle of the caisson during the pouring of the concrete. This cavity is critical to allow for the translation of screw as it moves up in down.

Jacking System

The jacking system of the present invention is dynamic and comprises two main components.

Screw

The screw is held by the screw jack housing and is translated through the housing by gears. The screw holds up the entire axial load of the building when the mechanical connection from the top cap to the exoskeleton is not engaged.

The screw has threads that the housing gears bear on.

Housing

The housing contains the gears that interface with the screw. As these gears turn, it translates the screw through the housing.

The housing gears support the entire load from the screw and the housing provides limited lateral support to keep the screw properly aligned.

Motor operator

The motor provides the mechanical force to turn the housing gears which in turn translate the screw.

The motor arrangement can be slightly different depending on the design. For example:

in the version where the housing is mounted to the top cap, each jack has an independent motor.

in the version where the housing is mounted to the bearing plate, there can be one motor tied to drive shafts that connect all jacks to that single motor.

Modular Building Components

Flexible Utility Connection(s)

FIG. 1 is a diagram of an embodiment 100 of a screw jack assembly. Screw jack 102 is coupled to screw jack housing 103. Screw jack housing 103 is coupled to a caisson cap assembly 104. Structural steel frames 106 belong to two different building modules that form different stories of the completed home. In this embodiment screw jack 102 pushes against the upper structural steel frame to lift the entire structure. This embodiment is quite sturdy, and replacement of damaged screw jacks is relatively easy. Rotating parts are attached to a caisson rather than part of the building structure (e.g. structural steel frame 106). The building structure need not be multi-level, and any second floor (or floor upon which the screw jack pushes) does not require open space above the screw jack except when replacement is needed.

Figure 2:
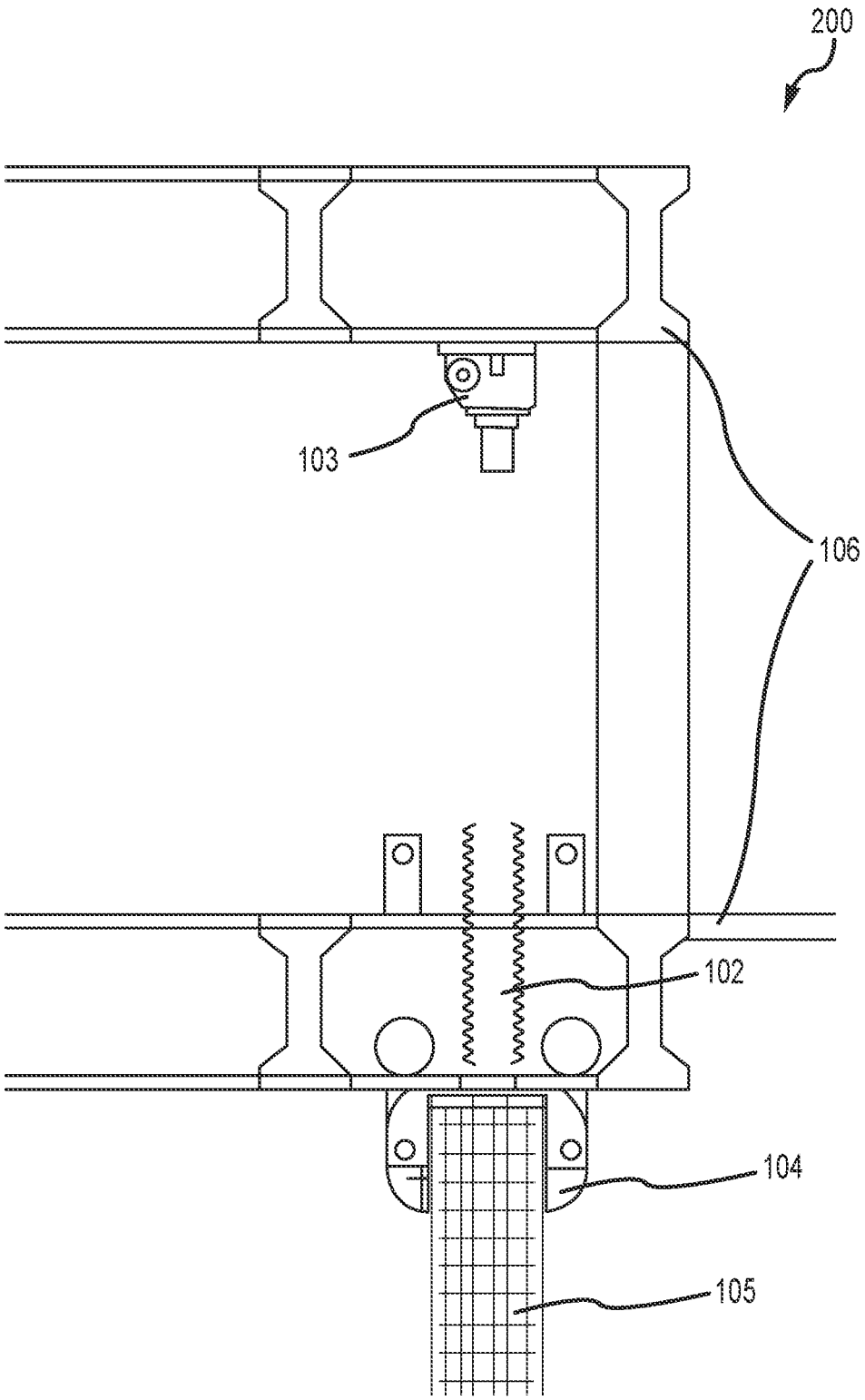
FIG. 2 is a diagram of another embodiment of a screw jack assembly.

FIG. 2 is a diagram of an embodiment 200 of a screw jack assembly. In this embodiment, the screw jack 102 is coupled to the screw jack housing 103 which is coupled to structural steel frame 106. In operation, the screw jack 102 pushes on the caisson cap 104. This arrangement allows for physical drive shafts between screw jacks, potentially eliminating the need for independent motors for each screw jack. This arrangement does not require a specialized cavity in part of the caisson cap for accommodating the screw jack housing 103. This arrangement allows for building to self-jack when not attached to permanent foundation. This arrangement allows for relatively easy adjustment if one or more caissons should settle out of plumb.

Figure 3:
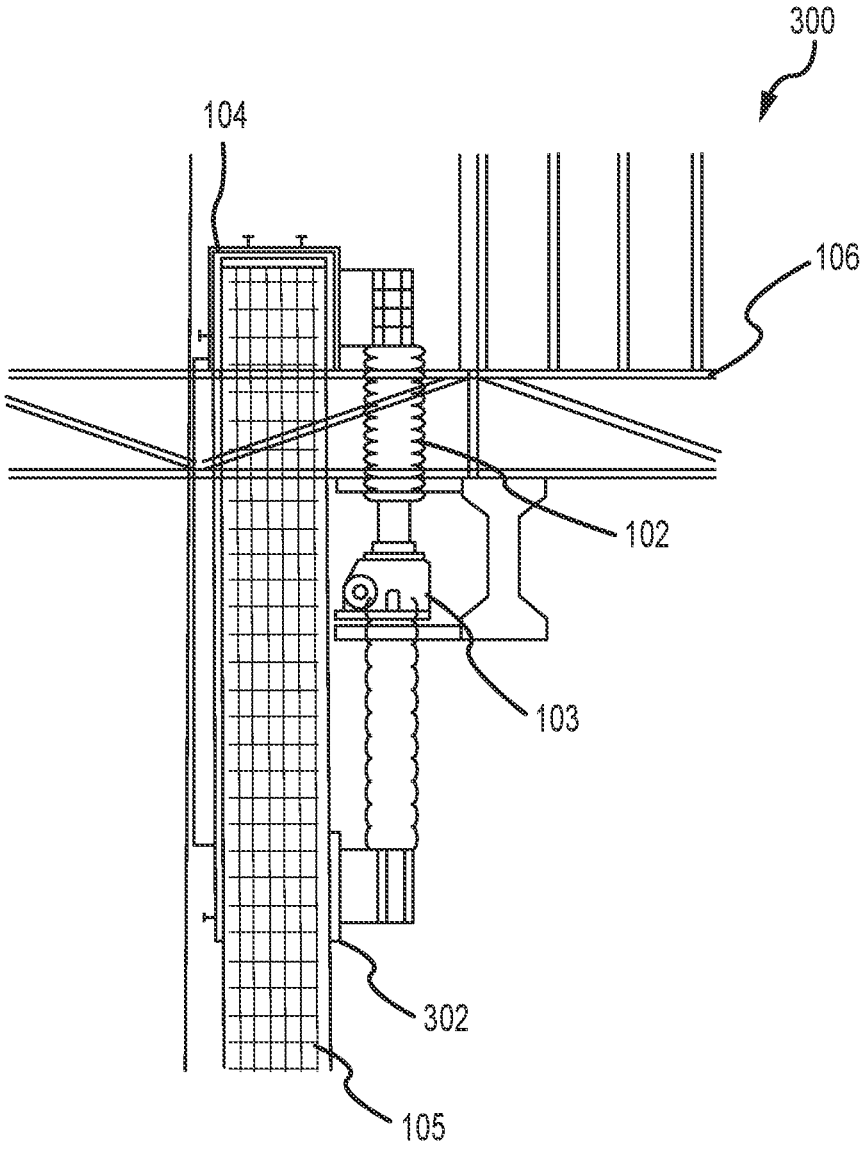
FIG. 3 is a diagram of another embodiment of a screw jack assembly.

FIG. 3 is a diagram of an embodiment 300 of a screw jack assembly. In this embodiment, the screw jack housing 102 is mounted to the caisson 105 through a caisson mounting structure 302. In this embodiment, the building effectively climbs the screw jack. This embodiment allows for the use of traditional long span joists or girders as an alternative to a building exoskeleton that include structural steel frame 106.

Figure 4:
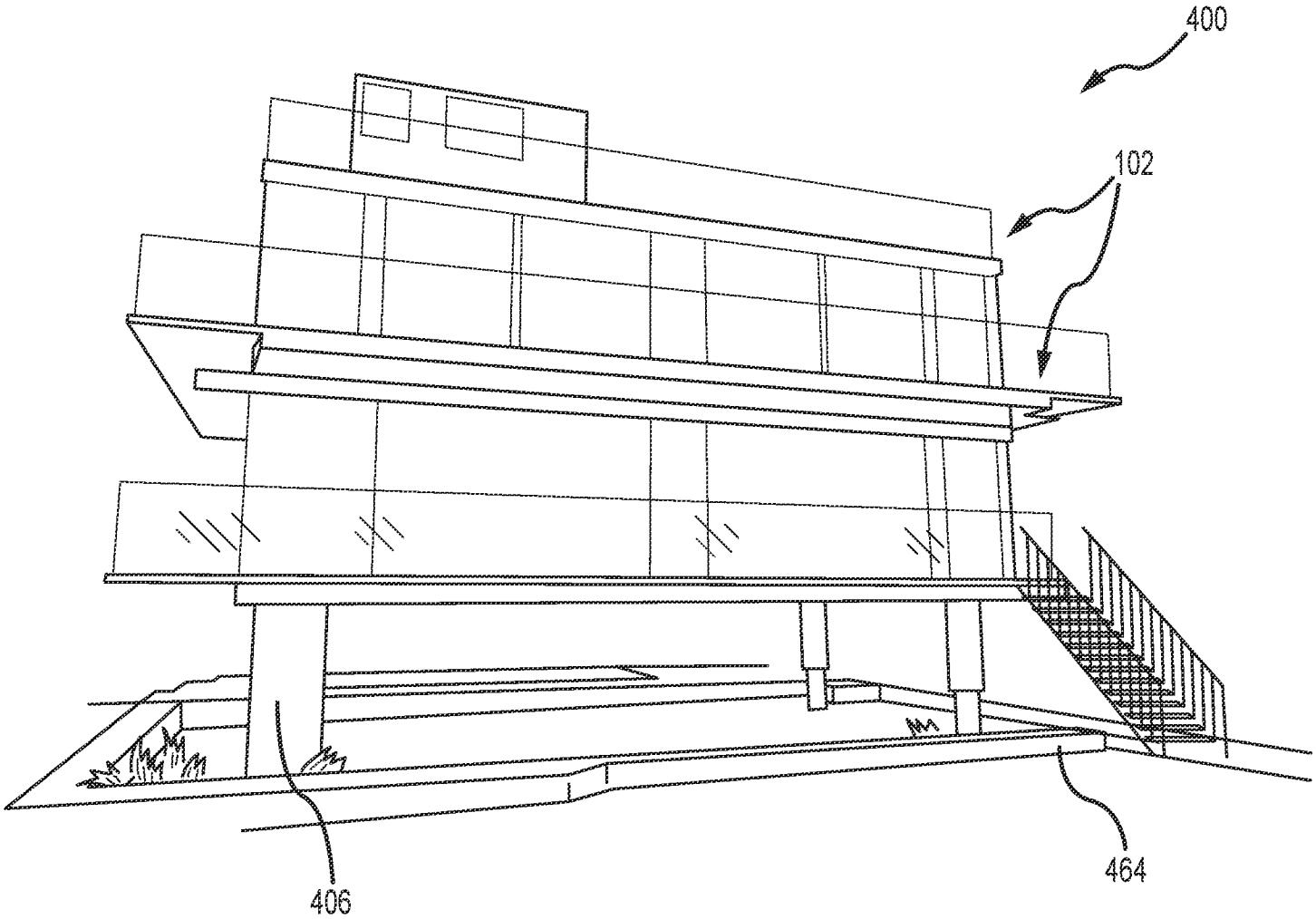
FIG. 4 is an illustration of completely assembled building structure according to an embodiment.

FIG. 4 is an illustration of completely assembled building structure 400 according to an embodiment. Building modules 102 are constructed over structural steel frames 106 (not shown). In this illustration, there are four caisson assemblies. Three of the caisson assemblies 404 are identical. Caisson assembly 406 is a utility caisson assembly 406 that provides for utility provision to the building structure 400, as will be further described with reference to following drawings.

The embodiment of FIG. 4 includes multiple sensors and controls which are not illustrated but are well known in the art. A programmable logic controller (PLC) is installed in a mechanical room. The PLC controls each screw jack motor. The PLC is coupled to multiple sensors that provide data to a homeowner. The PLC allows remote control of the building system ("building system" as used herein includes all moveable parts of the screw jack system, including screw jack 102, and all elements of caisson cap 104).

Figure 5:
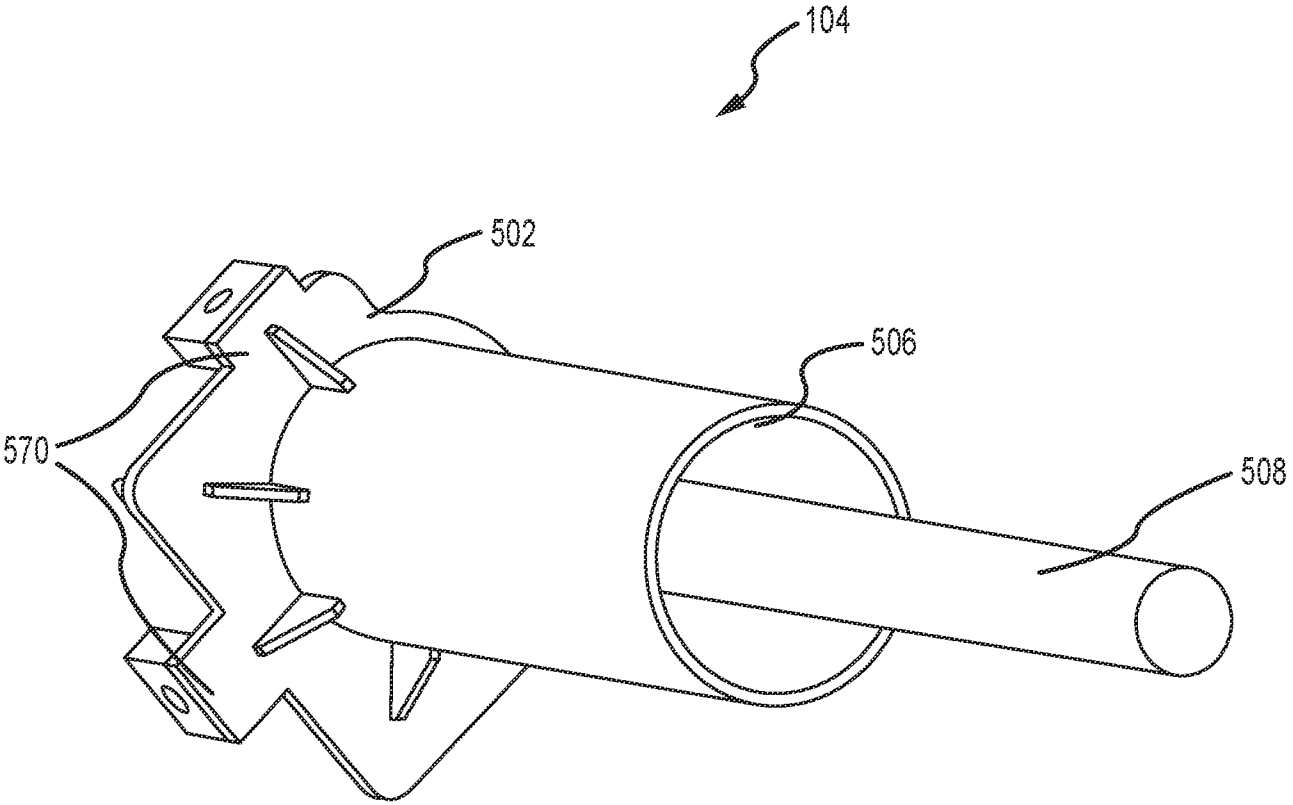
FIG. 5 is a diagram of a caisson cap assembly according to an embodiment.

Various sensors include, but are not limited to:

- For levelness and differential settlement
  - Smart level placed in building to ensure building stays level and plumb
- For raising:
  - Float sensor in utility connection assembly will raise home if flood waters are detected (blue)
  - PLC can also be linked via internet to national and local flood warnings
  - Torque at each jack will be monitored to ensure no jamming or other issues are occurring
- For lowering:
  - Laser net (similar to garage door laser) prevents building from lowering onto obstruction (red)
  - Visual, lidar, or ultrasonic sensors (similar to car backup camera) mounted on underside of lower modules monitor lowering operations to prevent damage from debris or changing ground level conditions (orange)
- All devices can be controlled by manual override and PLC is reprogrammable to owners desires FIG. 5 is a diagram of a caisson cap assembly 104 according to an embodiment. Caisson cap sleeve 506 in an embodiment is 2-3" larger in inside diameter than the outside diameter of a caisson casing. Top plate 502 includes lateral stabilizing tabs and blocks 510. Screw sleeve 508 in an embodiment is 2-3" larger in inside diameter than an outside diameter of screw jack 102.

Figure 6:
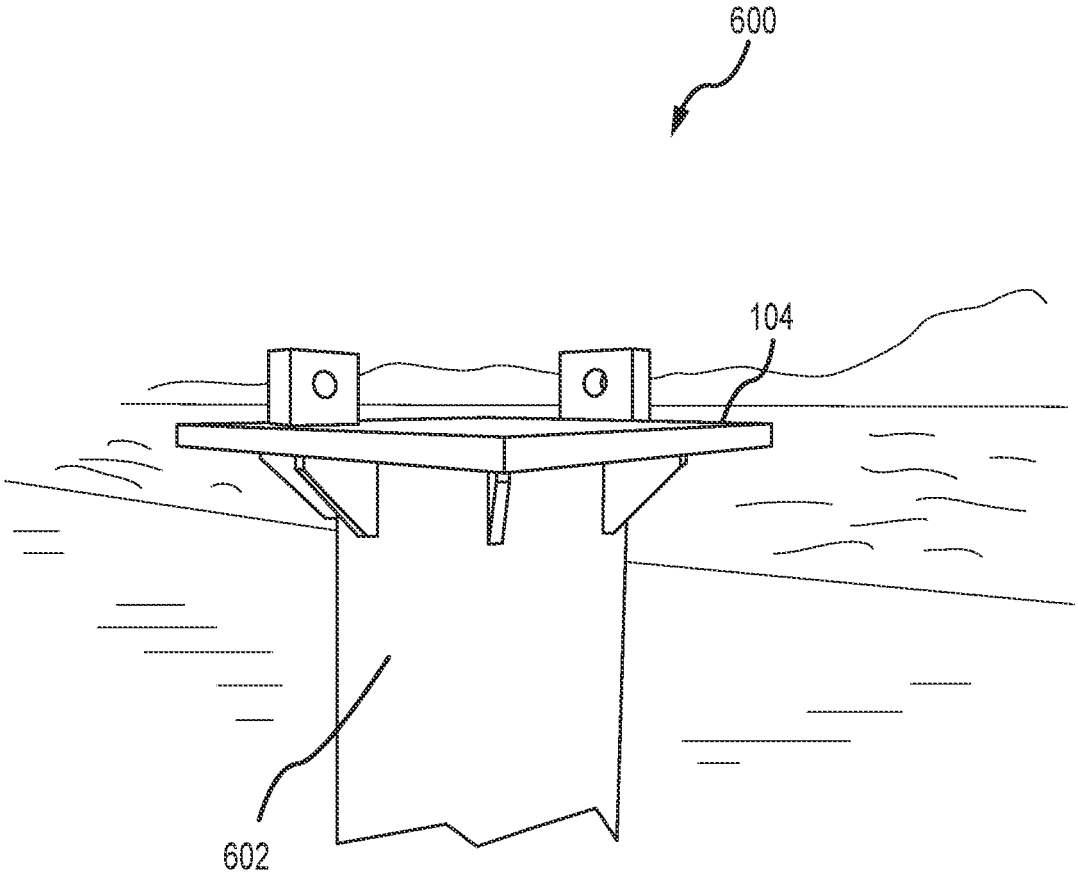
FIG. 6 is a diagram illustrating caisson placement according to an embodiment.

FIG. 6 is a diagram illustrating caisson placement 600. The caisson cap 104 is shown already placed on a caisson. Leveling hole/screws allow for leveling the caisson. A description of embodiment of caisson placement is as follows:

- Using pre-drilled holes, insert leveling screws
- These push against the caisson casing and allow for the caisson cap to be true, plumb and at the proper level
- This helps make up for construction tolerances of caisson drilling
- Construction tolerances:
  - Caisson drilling +/−6"
  - Caisson casing +/−2"
  - Caisson cap +/−½"
  - Screw mounting Jack +/−¼"

Figure 7:
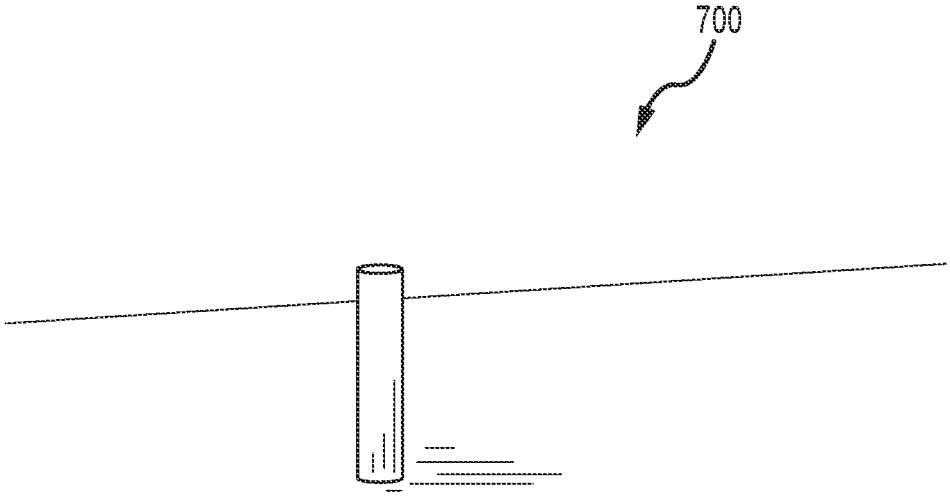
FIG. 7 is an illustration of a process of placing a caisson casing according to an embodiment.
Figure 8:
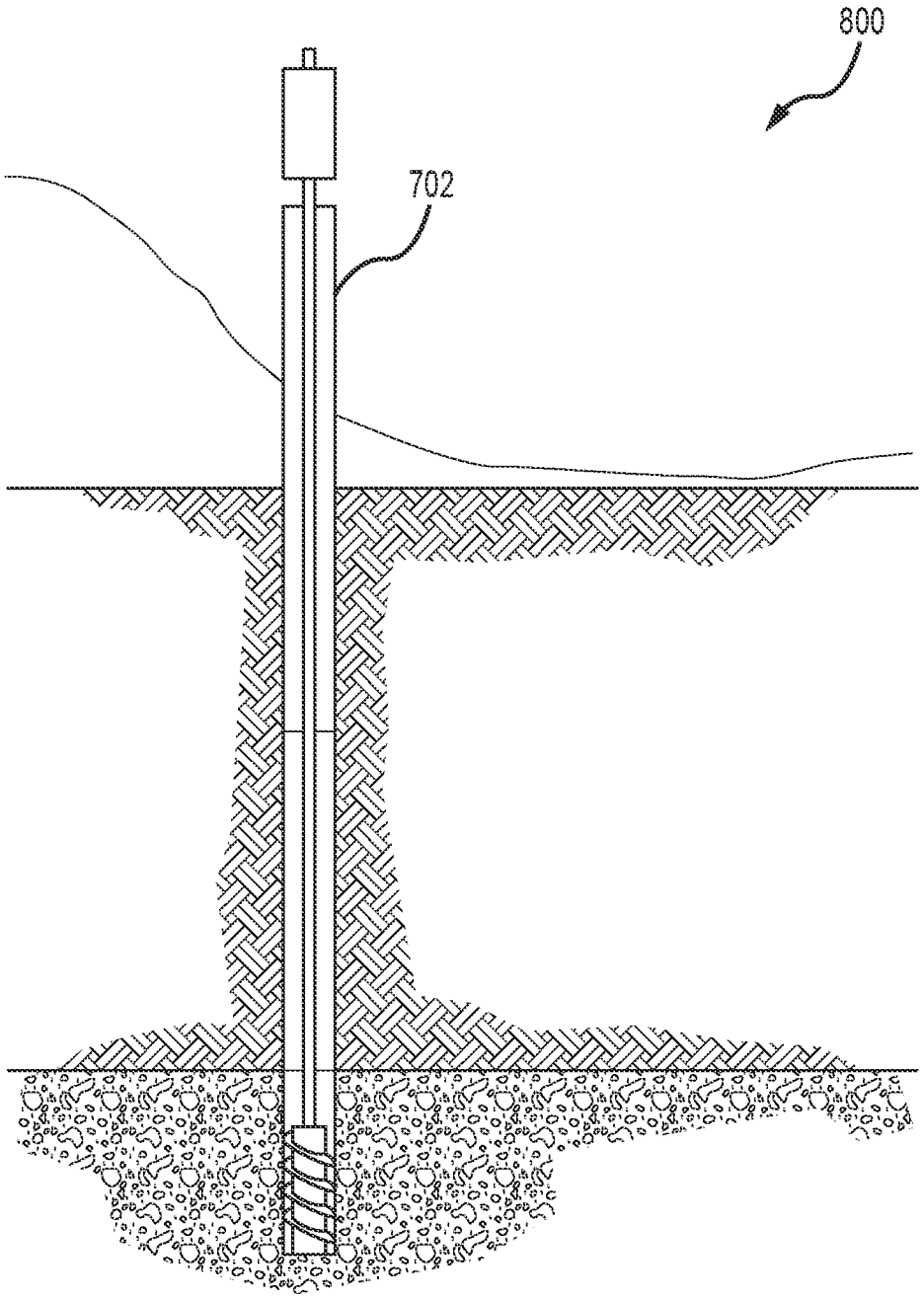
FIG. 8 further illustrates a process of placing a caisson according to an embodiment.

FIG. 7 is an illustration of a process 700 of placing a caisson casing according to an embodiment. Caisson casing 702 is shown in an environment where multiple caissons will be placed. The process in an embodiment is as follows:

- Place caissons casing
  - Steel or plastic casing that prevents hole from collapsing as caisson is dug
  - Effectively a 24"-36" tube, e.g.
- Casing is a typical measure for caisson construction
  - Casings may be either removed once concrete is poured or left in place
  - In this embodiment the final casing is left extending around 10-15' above grade
- Caisson location is determined by a survey and construction layout FIG. 8 further illustrates a process of placing a caisson according to an embodiment. Using casing 702, sand and/or soil is removed from the center of the casing 702 and drilling is performed to an engineered depth or a competent subsurface.

Figure 9:
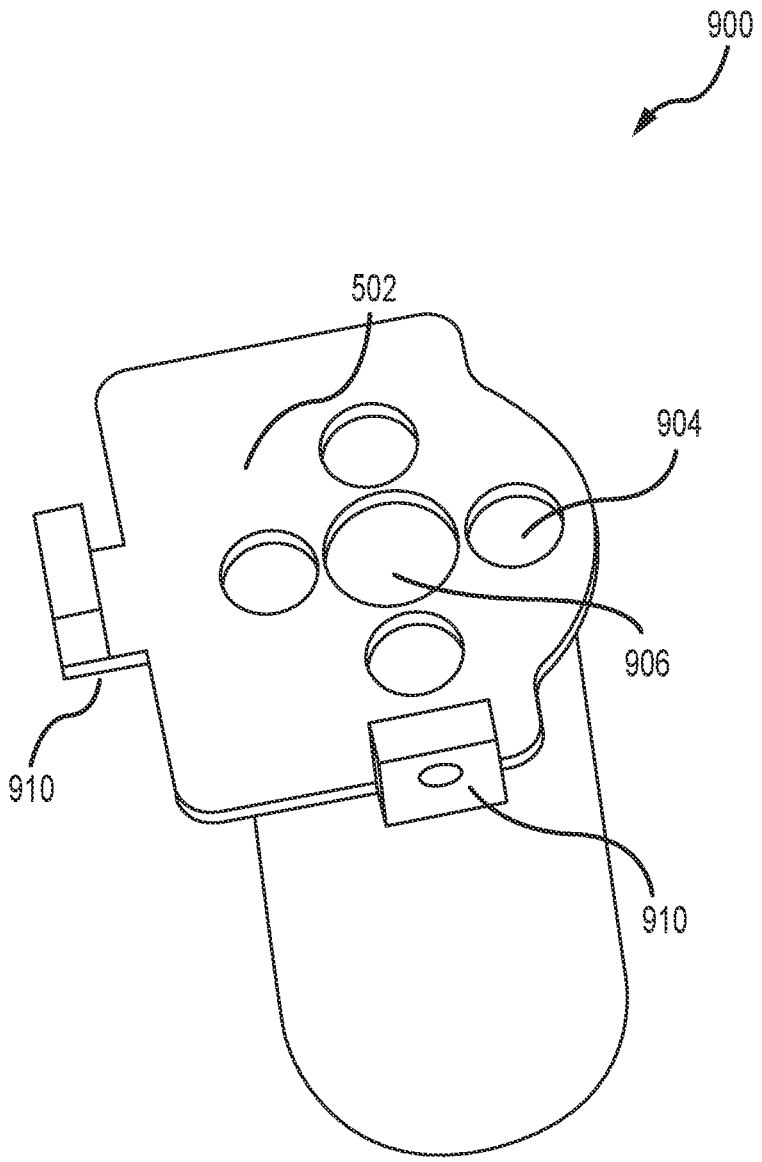
FIG. 9 is a diagram of a caisson cap assembly according to an embodiment.

FIG. 9 is a diagram of a caisson cap assembly 900 according to an embodiment. A top plate 502 is placed atop the caisson. Top plate 502 includes filling holes 904 for pouring concrete, and hole/cavity 906 for accommodating a crew jack 102. Lateral stabilizing tabs and blocks 910 are engaged with the building structure as further described below.

Figure 10A:
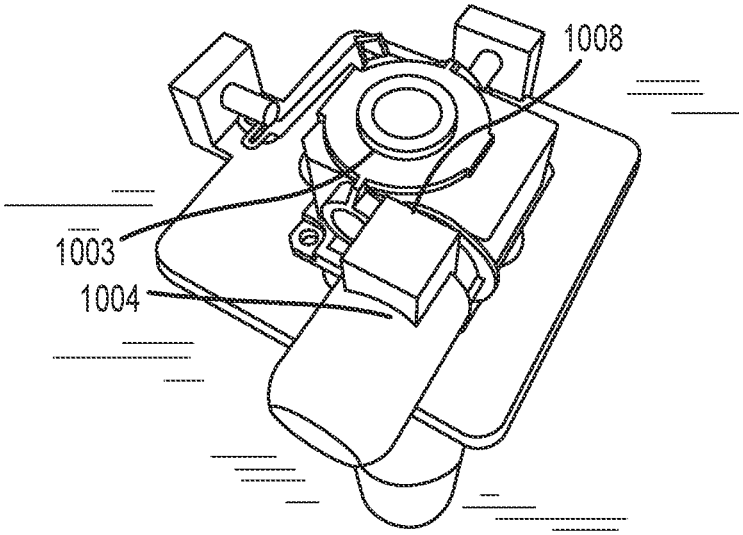
FIG. 10A is a diagram further illustrating mechanisms for caisson placement.

FIG. 10A is a diagram further illustrating mechanisms for caisson placement. A screw jack housing 103 is shown, as well as a screw jack drive motor 1004. A lockout mechanism 1008 is installed at the screw jack drive motor 1004.

Figure 10B:
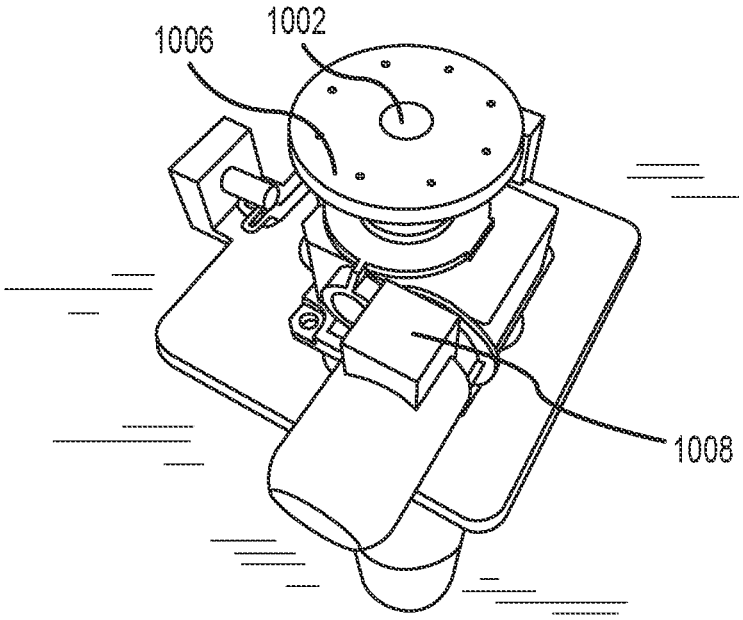
FIG. 10B is a diagram further illustrating mechanisms for caisson placement.

FIG. 10B is a diagram further illustrating mechanisms for caisson placement. This diagram shows a screw jack screw 102 and a screw jack bearing plate 1006.

Figure 11:
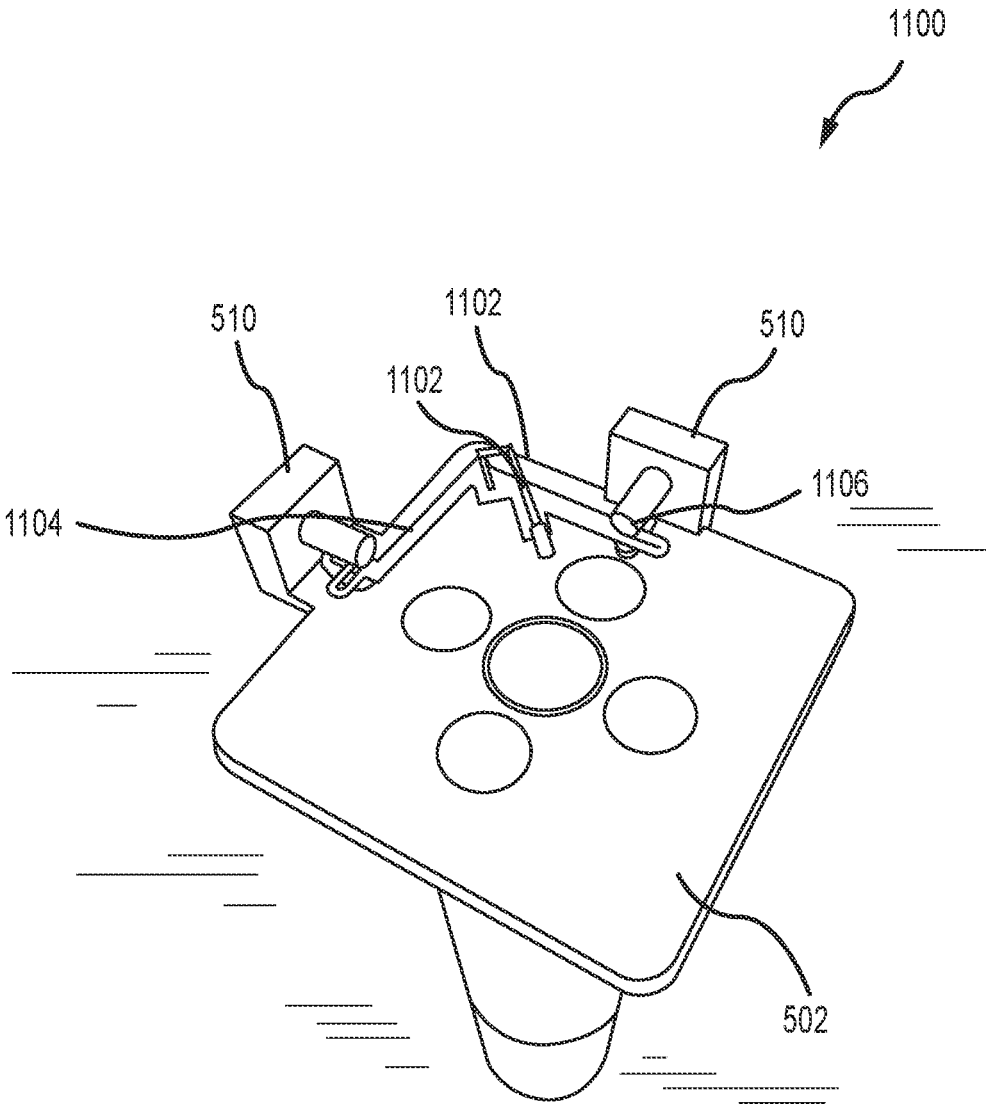
FIG. 11 is an illustration of a lockout assembly according to an embodiment.

FIG. 11 is an illustration of a lockout assembly 1100 according to an embodiment. Employment of the lockout assembly 1100 is an aspect of caisson placement according to an embodiment. Top plate 502 is shown. Elements of the lockout mechanism include a linear actuator 1102, a sliding mechanism 1104, and lockout cotter pins 1106. The elements are fastened to top plate 502 via predrilled holes. Cotter pins 1106 are pushed in or out via lateral stabilizing blocks 510.

Figure 12:
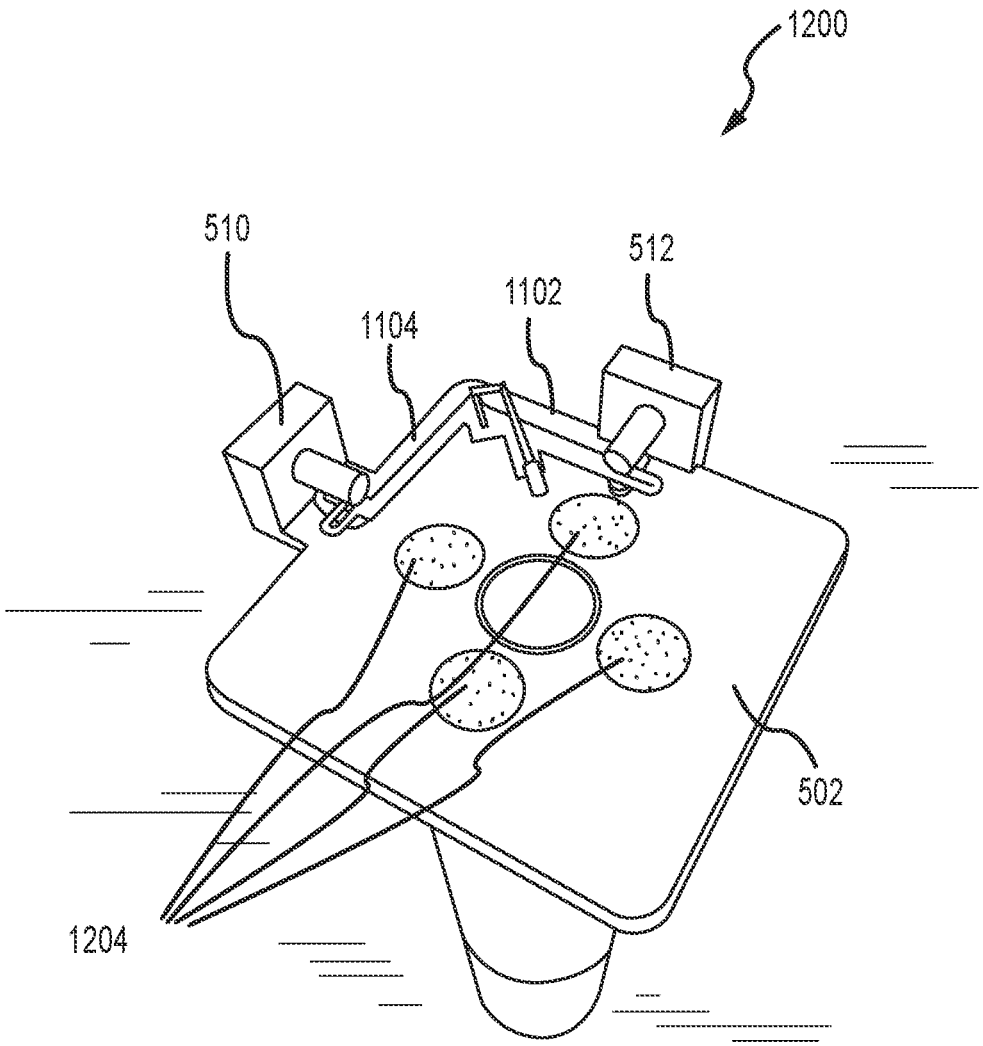
FIG. 12 illustrates the a caisson cap with and lockout mechanism and calls out further elements of a completed assembly.

FIG. 12 shows the caisson cap 502 and lockout mechanism and calls out further elements of the completed assembly 1200. The opening 1202 in the center of the caisson cap 502 accommodates the screw jack 102. Openings 1204 are shown filled with concrete. A caisson installation sequence according to an embodiment includes: laying out and placing all caisson casings; performing caisson drilling; leveling all casings; rebar installation before concrete pouring; installation of utility connection assembly; installation of all caisson caps; concrete pouring and grouting; and installation of lockout mechanisms and screw jacks.

Figure 13A:
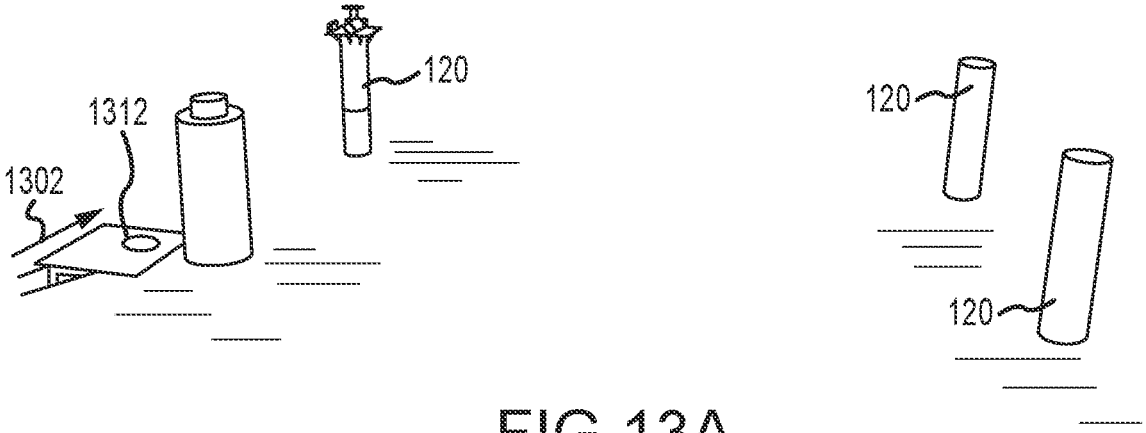
FIG. 13A, illustrates a partially completed caisson layout according to an embodiment.

FIG. 13A illustrates a partially completed caisson layout 13A according to an embodiment. In this embodiment, three caisson assemblies 120 are shown. One caisson assembly with utility connection assembly 1302 is shown. In various embodiments, there can be various numbers of caisson assemblies 120 and caissons assembly with utility connection assembly 1302. In this particular example, the utility connection assembly 1302 is installed on one predetermined caisson casing. The location is determined based on factors such as site-specific requirements and optimal connection points to existing utilities (see element 1312). The utility connection assembly 1302 is typically installed prior to the installation of the caisson cap 104.

Figure 13B:
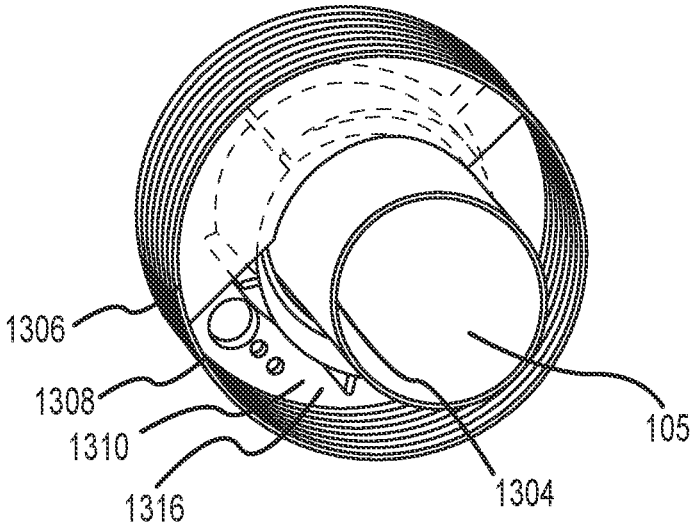
FIG. 13B is an illustration of a top of a utility caisson and a utility caisson assembly according to an embodiment.

FIG. 13B is an illustration of the top of the utility caisson and the utility caisson assembly 1302. Stub-ups 1306 are holes in a utility collar 1316 for letting utilities through into the home. Protective bellows 1308 surrounds the entire caisson and expands and contracts when the entire structure is raised or lowered. Within the utility collar 1316 in a space 1310 for coiled utility cables/lines/hoses, etc.

Figure 13C:
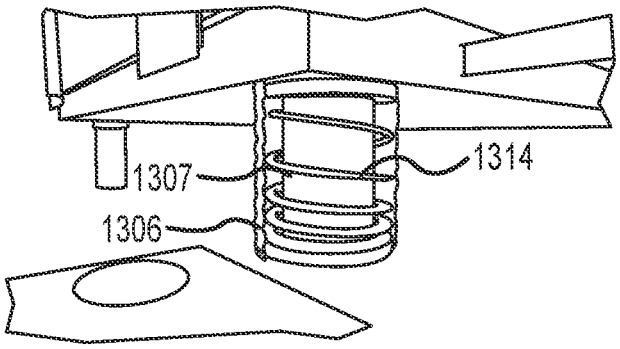
FIG. 13C is an illustration of the utility caisson assembly in partial cross-section according to an embodiment.

FIG. 13C is an illustration of the utility caisson assembly 1302 in partial cross-section. nested spiral utilities 1307 allow for up and down movement of the entire structure while preserving a proper slope for gravity utilities such as sewer. Utilities include water, gas, sewer electric and telecom.

Figure 14:
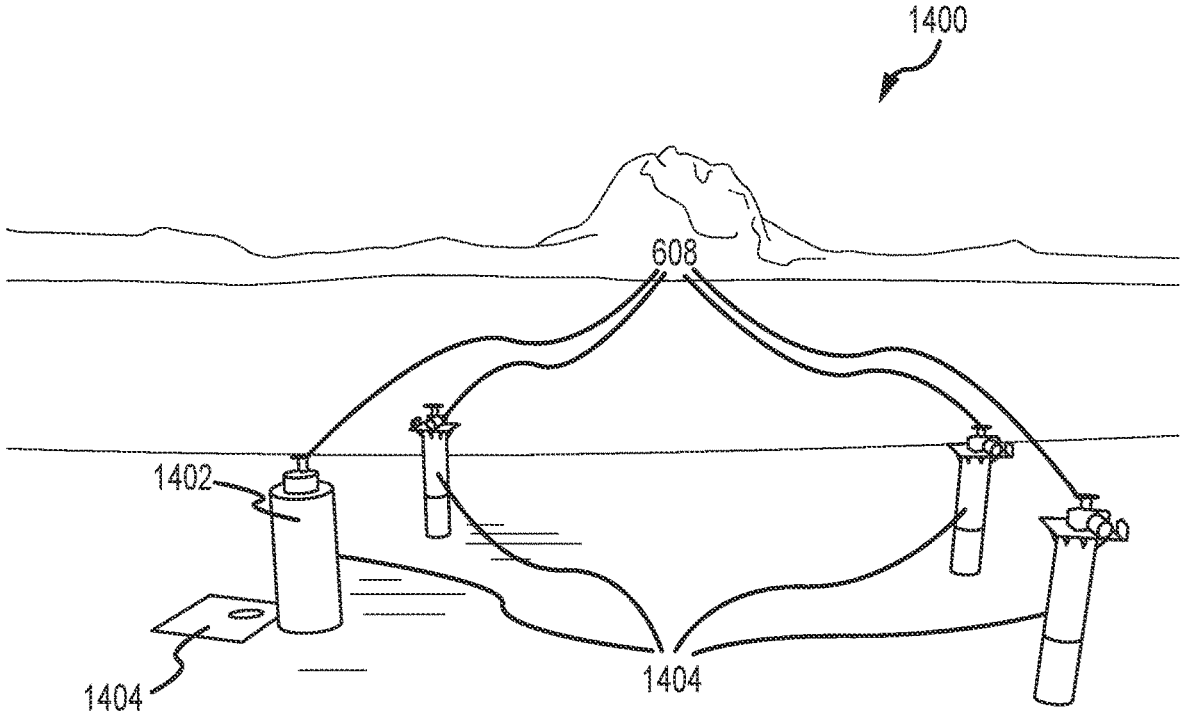
FIG. 14 is an illustration of caisson placement prior to installation of modules according to an embodiment.

FIG. 14 is an illustration of caisson placement 1400 prior to installation of modules according to an embodiment. In this embodiment, there are four caisson assemblies 404. The leftmost caisson assembly includes a utility connection assembly 1402 adjacent to a standard utility connection point 1404. screw jack assemblies 608 are also shown and each of the caisson assemblies 404. Once all caissons and screw jack assemblies are installed, and concrete and grout is cured, building modules can be installed.

Figure 15A:
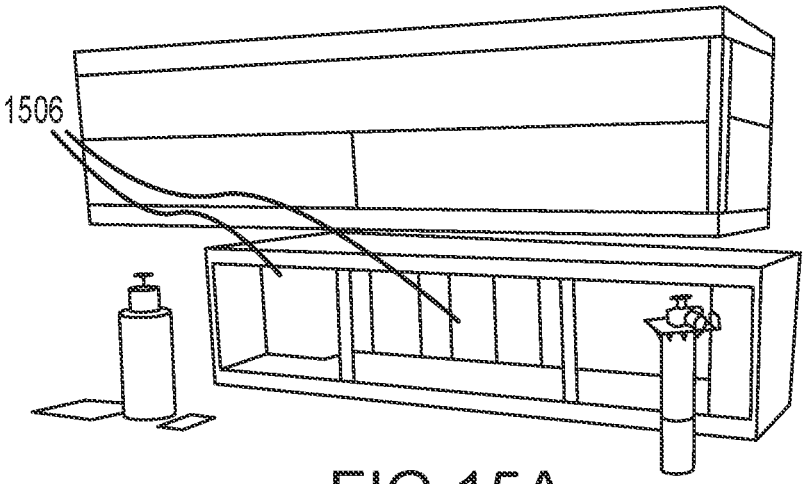
FIGS. 15A, 15B and 15C illustrate module assembly according to an embodiment.
Figure 15B:
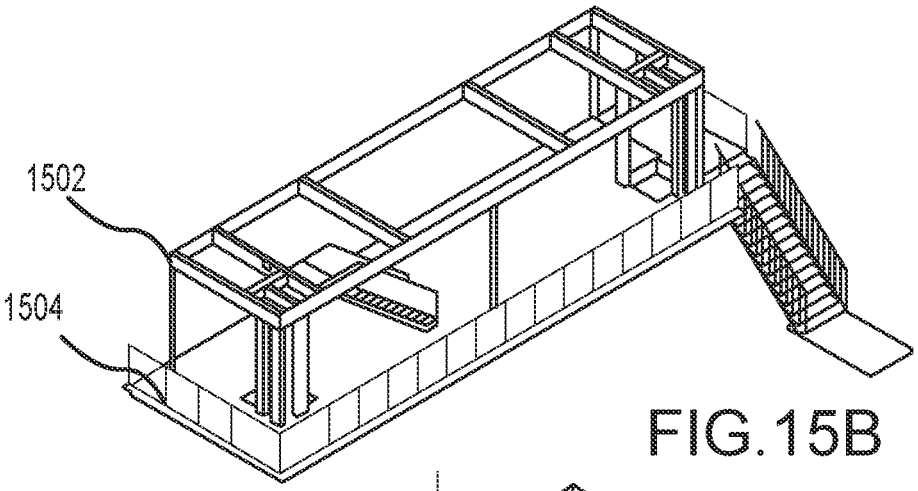
Figure 15C:
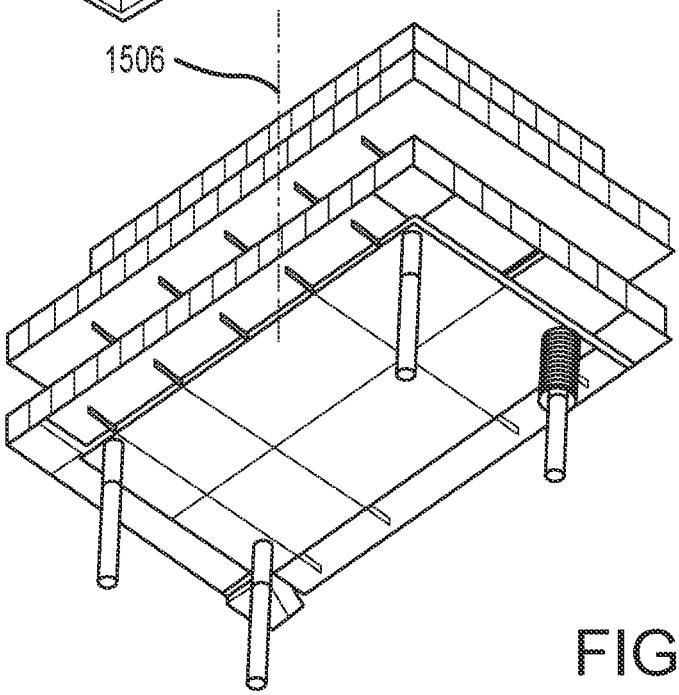

FIGS. 15A, 15B and 15C illustrate module assembly according to an embodiment. in an embodiment, modules are shipped to a project almost fully furnished. This includes a structural steel frame 1502. Other elements of a module include collapsible decking 1504 that can serve as hurricane shutter when drawn up. Infill architectural walls and floors 1506 are additional elements. Internal electrical, mechanical and plumbing system can be included. In essence, an architect can include any permanent features such as cabinetry, millwork, appliances, and anything else that is desired to be include within the confines of the structural steel frame 1502.

Figure 16:
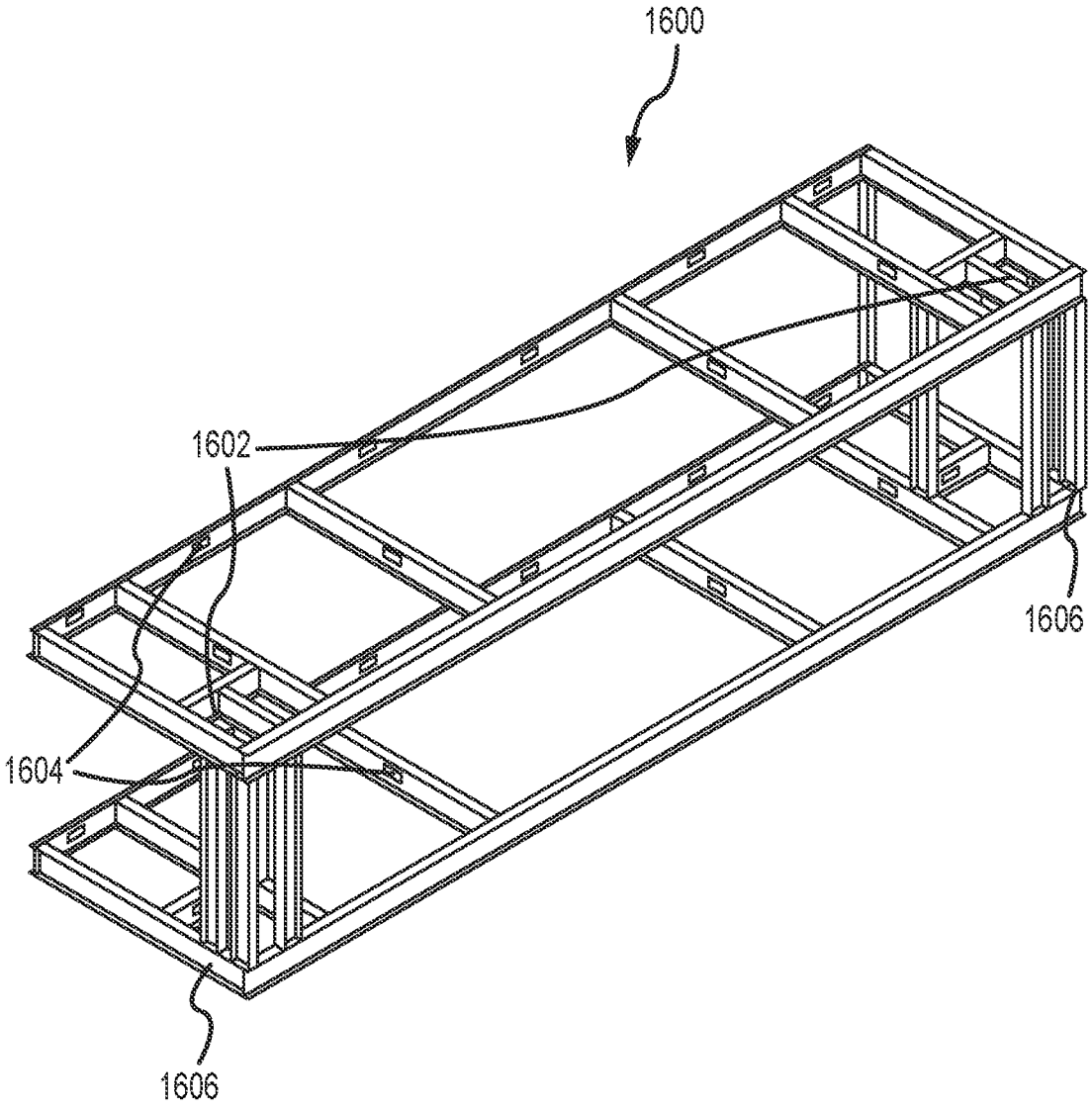
FIG. 16 is an illustration of a structural steel frame according to an embodiment.

FIG. 16 is an illustration of a structural steel frame 1600 according to an embodiment. Steel frame 1600 is the support structure for a floor of the entire home structure. Multiple modules can make up multiple floors of an entire home structure. In an embodiment, a structural steel frame 1600 effectively hangs a first floor from the tops of screw jack bearing plates 1006 whose locations are roughly shown by element number 1602. In this illustration the two structural steel frame 1600 corners in the foreground show more detail related to caisson accommodation structure 1606. The remaining corner also include this detail, but it is not shown here. Particular sections of the frame 1600 have punched holes 1604 to allow for internal electrical, mechanical, and plumbing conduits to be run.

Figure 17:
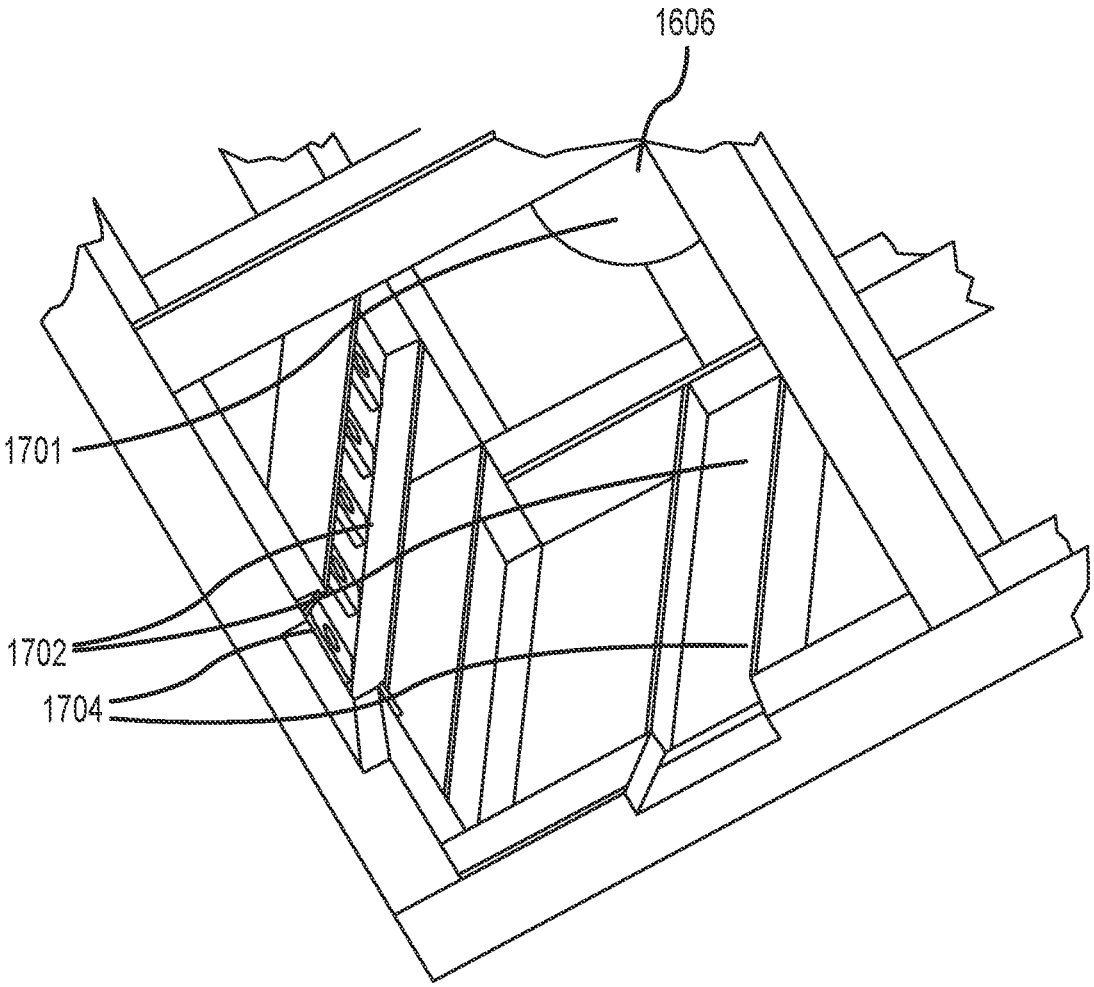
FIG. 17 is an illustration of a caisson receiving area according to an embodiment.

FIG. 17 is an illustration of a caisson receiving area 1606 according to an embodiment. This structural subassembly includes module screw bearing plate 1701. Module screw bearing plate 1701 pushes against module screw jack bearing plate 1006 and effectively is a key load-bearing point for the structure.

Lateral stabilizing channels 1702 include vacancies for through which lateral stabilizing tabs 510 are inserted. lockout receivers 1704 are holes through which cotter pins 1106 are inserted when the lockout system is engaged.

Figure 18:
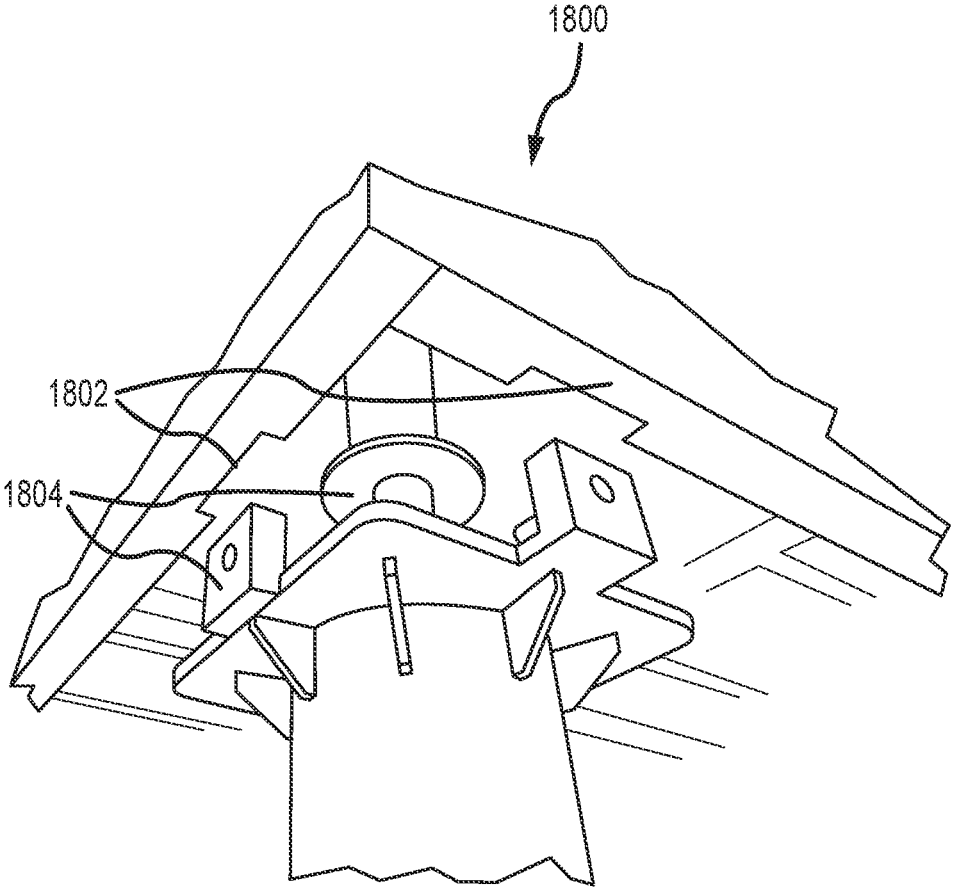
FIG. 18 is an illustration of a caisson receiving area of a completed installation according to an embodiment.

FIG. 18 is an illustration of a caisson receiving area 1800 of a completed installation. the flared ends of the module lateral stabilizing channels 1802 and the caisson cap lateral stabilizing taps/blocks 1804 are shown. Elements 1802 and 1804 are intended to nest together during service. The two elements will rub against each other on a sacrificial wear surface designed to slide and wear over time. In some embodiments, polycarbonate sheets may be attached to either channel block or walls for this purpose, but embodiments are not so limited.

Figure 19:
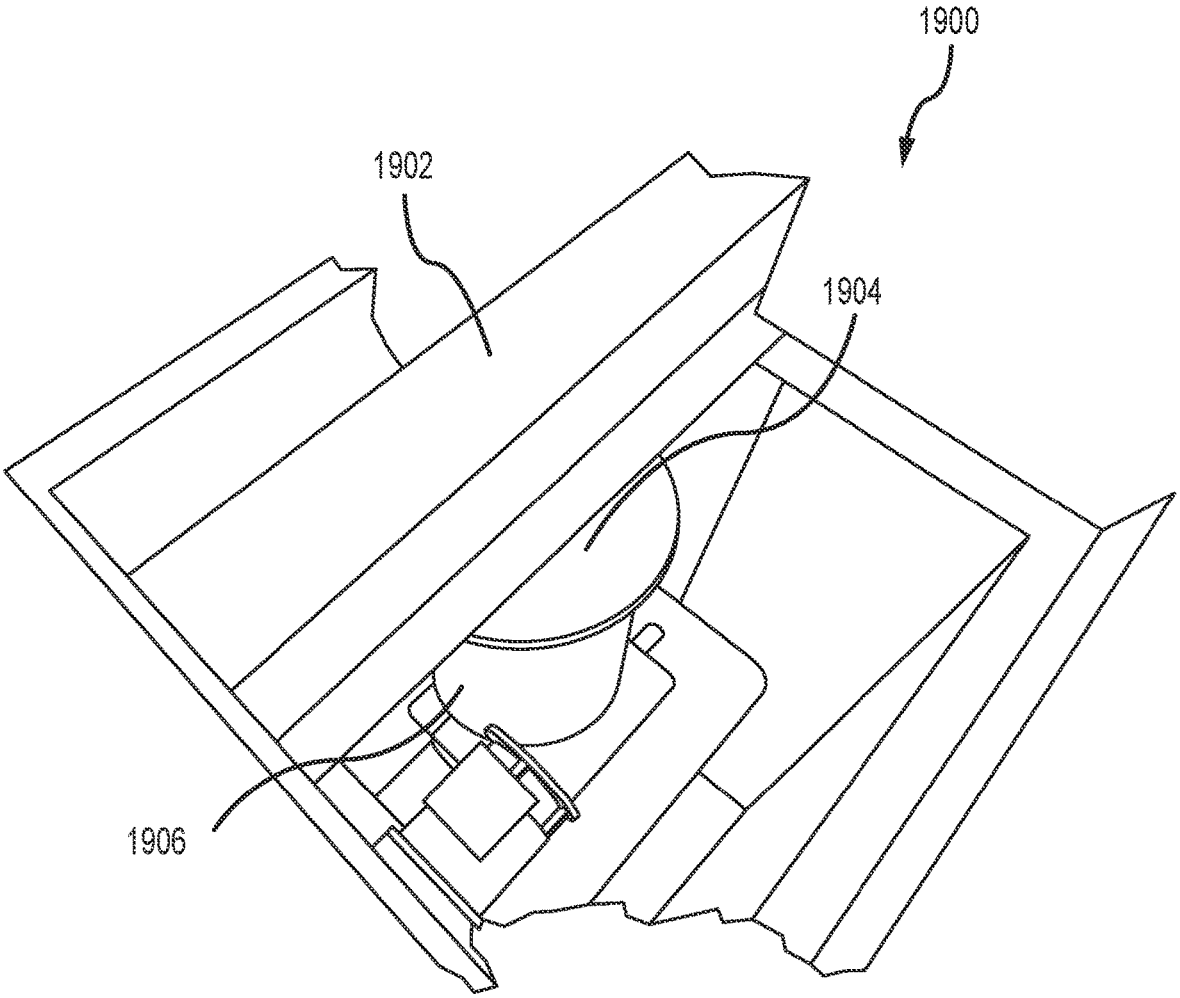
FIG. 19 is an illustration of a caisson receiving area after module placement according to an embodiment.

FIG. 19 is an illustration of a caisson receiving area after module placement. A structural steel frame support beam 1902 of a module is shown. A module bearing plate 1904 is shown supporting the module. A screw jack bearing plate 1006 is also shown. The plate 1006 bears on the plate 1904 effectively allowing for vertical loads from the structural steel frame to be transferred to the caisson via the screw jack assembly. The plate 1904 can be removed to allow for screw jack replacement if needed.

The following claims are not intended to be limiting in any way in terms of defining the inventions disclosed herein.

What is claimed is:

1. A building support system comprising:

a plurality of caissons that extend below building grade to one or more of an engineered depth and a competent subsurface;

a plurality of caisson caps, wherein each of the plurality of caissons is coupled to one of the plurality of caisson caps, respectively, each caisson cap sitting atop each caisson, each caisson cap comprising, a top plate that includes multiple openings for pouring concrete for the caisson;

a lockout mechanism for locking the caisson to one of a plurality of structural support members of a building module;

a plurality of stabilizing tabs and blocks for mating with the one of the plurality of structural support members of the building module;

a screw sleeve oriented in a center of the caisson cap for accommodating a screw jack that moves up and down substantially along a central axis of the caisson;

a screw jack bearing plate positioned at a topmost point of the screw jack, wherein a plane of the screw jack bearing plate is perpendicular to the central axis of the caisson; and a module bearing plate coupled to the one of the plurality of structural support members of the building module, wherein the screw jack bearing plate bears on the module bearing plate and supports and raises and lowers the building module when the jack screw is rotated.

2. The building support system of claim 1, wherein each of the plurality of caissons comprise an above ground section and a below ground section.

3. The building support system of claim 2, wherein the below ground section relies on both skin friction and an end bearing to support and anchor the building in place.

4. The building support system of claim 2, wherein the above ground section comprises an integral, permanent casing that is adjustable for any construction tolerance issues.

5. The building support system of claim 1, wherein one of the plurality of caissons comprises a caisson assembly with a utility connection assembly.

6. The building support system of claim 5, wherein the utility connection assembly comprises a utility collar that includes holes for letting utilities in the building module.

7. The building support system of claim 6, wherein the utility connection assembly comprises protective bellows that surround the caisson and expand and contract when the building module is raised or lowered, and a space for coiled utility lines and hoses.

8. The building support system of claim 1, further comprising multiple electronic sensors and controls for the multiple electronic sensors, wherein the sensors comprise one or more of:

a levelness and differential settlement sensor;

a float sensor to raise the building module when flood waters are detected;

a torque monitor for each jack screw to detect jamming or other issues;

a laser net to prevent the building module lowering onto an obstruction; and sensors mounted such as to prevent damage from obstructions including debris and changing ground level conditions.

9. The building support system of claim 8, wherein the controls comprise a programmable logic controller (PLC) that controls jack screw motors of each jack screw.

10. The building support system of claim 9, wherein the PLC allows remote control of all jack screws and all elements of each caisson cap.

11. The building support system of claim 1, wherein the building module includes a frame comprised of structural support members having an upper portion, the upper portion including two or more module bearing plates and wherein one of the screw jack bearing plate interfaces with the building module at the two or more module bearing plate at the upper portion of the building frame, respectively.

* * * * *